US005707054A

United States Patent [19]

Loquet et al.

[11] Patent Number: 5,707,054

[45] Date of Patent: Jan. 13, 1998

[54] FOLDING APPARATUS HAVING A COPY-FORMING AUXILIARY MODULE

[75] Inventors: Guy Loquet, Liancourt; Rene Renard, Montigny les Cormeilles; Serge Lanvin, Cires les Mello, all of France

[73] Assignees: Heidelberger Druckmaschinen AG, Heidelberg, Germany; Heidelberg Harris, S.A., Montataire Cedex, France

[21] Appl. No.: 639,424

[22] Filed: Apr. 29, 1996

[30] Foreign Application Priority Data

Apr. 28, 1995 [FR] France ..... 95 05141

[51] Int. Cl.[6] ..... B41F 13/58

[52] U.S. Cl. ..... 270/6; 270/5.03; 270/21.1; 270/42; 270/43

[58] Field of Search ..... 270/4, 5.01, 5.02, 270/5.03, 6, 20.1, 21.1, 41, 42, 43

[56] References Cited

U.S. PATENT DOCUMENTS

| | | | |
|---|---|---|---|
| 2,014,016 | 9/1935 | Crafts | 270/41 |
| 4,559,032 | 12/1985 | Fischer | 270/41 X |
| 5,527,256 | 6/1996 | Vauchelle et al. | 270/6 X |

FOREIGN PATENT DOCUMENTS

| | | | |
|---|---|---|---|
| 0 222 150 A2 | 5/1987 | European Pat. Off. . | |
| 0 222 151 A2 | 5/1987 | European Pat. Off. . | |
| 0256333 | 2/1988 | European Pat. Off. . | |
| 0374917 | 6/1990 | European Pat. Off. . | |
| 0400596 | 12/1990 | European Pat. Off. . | |
| 2575701 | 7/1988 | France . | |
| 0295374 | 12/1988 | Japan | 270/21.1 |
| 2 078 684 | 1/1982 | United Kingdom . | |
| 2110191 | 6/1983 | United Kingdom | 270/4 |
| 2 263 692 | 8/1993 | United Kingdom . | |

*Primary Examiner*—Hoang Nguyen

*Attorney, Agent, or Firm*—Herbert L. Lerner; Laurence A. Greenberg

[57] ABSTRACT

Folding apparatus having a main folder and an associated auxiliary cutting module for cutting into copies at least one longitudinally folded strip or web section originating from a web coming from a rotary printing press, the auxiliary cutting module having an inlet thereto for the at least one strip, and an outlet therefrom for respective copies cut from the at least one strip, the inlet and the outlet defining therebetween a straight travel path for the at least one strip and the copies cut therefrom, respectively, and a cutting cylinder having two angularly offset knives, and a counter-cutting cylinder, respectively, disposed on opposite sides of the straight travel path and of the at least one strip traveling thereon, the cutting cylinder and the counter-cutting cylinder, respectively, cooperating with one another for performing two successive cutting operations in one revolution of the cylinders.

9 Claims, 3 Drawing Sheets

FOLDING APPARATUS HAVING A COPY-FORMING AUXILIARY MODULE

BACKGROUND OF THE INVENTION

FIELD OF THE INVENTION

The invention relates to a folding apparatus having a copy-forming auxiliary module, more particularly, having a main folder or folding device and an associated auxiliary cutting module for cutting into copies at least one longitudinally folded strip or web section originating from a web coming from a rotary printing press.

Heretofore known from published French Patent Document FR 2,575,701, is a folding apparatus of this general type wherein an auxiliary cutting module is arranged so that a web section or strip, or a plurality thereof travel between an inlet and an outlet of the cutting module along an S-shaped path while it or they, respectively, are supported by a conveyor belt in a first bend of the S-shaped path. The auxiliary cutting module of the folding apparatus heretofore known from the aforementioned French document includes two cutting cylinders arranged in succession along the S-shaped path at the level of the first bend. Each cutting cylinder includes a knife for cooperating with a cutting counter-cylinder arranged between the two cutting cylinders on the other side of the through-put strip or strips, or web section or sections, and for producing two successive cuts in the respective strip or web section or a plurality thereof traveling along the S-shaped path.

A major drawback of the aforementioned folding apparatus is that the S-shaped path which the strip or web section, or the plurality thereof follow through the associated auxiliary cutting module is long and complicated and requires at least one conveyor belt or tape to support the respective strip or strips between the two cutting cylinders.

Due to the complicated specific layout of this cutting module, the performance thereof is reduced and limited.

SUMMARY OF THE INVENTION

It is accordingly an object of the invention to provide a folding apparatus having a copy-forming auxiliary module which increases the production capability of a conventional folding device and, in particular, of an associated auxiliary cutting module.

With the foregoing and other objects in view, there is provided, in accordance with the invention, a folding apparatus having a main folder and an associated auxiliary cutting module for cutting into copies at least one longitudinally folded strip or web section originating from a web coming from a rotary printing press, the auxiliary cutting module comprising an inlet thereto for the at least one strip, and an outlet therefrom for respective copies cut from the at least one strip, the inlet and the outlet defining therebetween a straight travel path for the at least one strip and the copies cut therefrom, respectively, and a cutting cylinder having two angularly offset knives, and a counter-cutting cylinder, respectively, disposed on opposite sides of the straight travel path and of the at least one strip traveling thereon, the cutting cylinder and the counter-cutting cylinder, respectively, cooperating with one another for performing two successive cutting operations in one revolution of the cylinders.

In accordance with another feature of the invention, the straight travel path through the auxiliary cutting module is a vertical path.

In accordance with a further feature of the invention, the folding apparatus includes a deposit site common to both the main folder and the auxiliary cutting module for receiving the copies thereon, and a conveyor belt is arranged between the outlet of the auxiliary cutting module and the deposit site for conveying the copies produced by the auxiliary cutting module to the deposit site.

In accordance with an added feature of the invention, the auxiliary cutting module, at the outlet thereof, includes a fan wheel for accepting the cut copies therein and depositing them in a shingle stream layer on the conveyor belt.

In accordance with an additional feature of the invention, the folding apparatus includes a force transmission device for transmitting driving force from a drive of the folding apparatus to the auxiliary cutting module for driving the latter.

In accordance with yet another feature of the invention, the force transmission device has a construction selected from the group of constructions consisting of belt-type transmissions, chain-type transmissions, and gear transmissions.

In accordance with yet a further feature of the invention, the main folder has a folder former for longitudinally folding at least one strip originating from a web coming from a rotary printing press, and a web transferring device is provided for transferring the strip between an outlet of the folder former of the main folder and the inlet of the auxiliary cutting module.

In accordance with a concomitant feature of the invention, the auxiliary cutting module has a folder former for longitudinally folding at least one strip originating from a web coming from a rotary printing press.

Such a construction of the auxiliary cutting module in accordance with the invention permits a considerable increase in the production of copies and, thereby, a corresponding increase in the overall production of the folding machine.

It should be emphasized that the main folder or folding device and the associated auxiliary cutting module alternatingly operate independently of one another. The processing speeds of the auxiliary cutting module are increased due to the straight travel path therein and the double knife cutting cylinder, which permits a considerable increase in productivity in comparison with the production of heretofore known devices of this general type. Furthermore, the straight travel path through the auxiliary cutting module permits the elimination of the conveyor belt at the level of the cutting cylinder, which simplifies the construction of the module.

Because it has been found to be advantageous for the auxiliary cutting module of the folding apparatus not to have its own drive, the invention calls calls for it to be driven via a force transmission device by the drive of the folding apparatus.

The auxiliary cutting module is constructed as an accessory module which may thus be coupled by means of the force transmission device of the main folder, in a relatively simple manner.

As aforenoted, the force transmission device may have either a belt transmission, a chain transmission or a gear transmission.

Other features which are considered as characteristic for the invention are set forth in the appended claims.

Although the invention is illustrated and described herein as embodied in a folding apparatus having a copy-forming auxiliary module, it is nevertheless not intended to be limited to the details shown, since various modifications and structural changes may be made therein without departing from the spirit of the invention and within the scope and range of equivalents of the claims.

The construction and method of operation of the invention, however, together with auxiliary objects and advantages thereof will be best understood from the following description of specific embodiments when read in connection with the accompanying drawings.

DESCRIPTION OF THE PREFERRED EMBODIMENT

Figure 1:
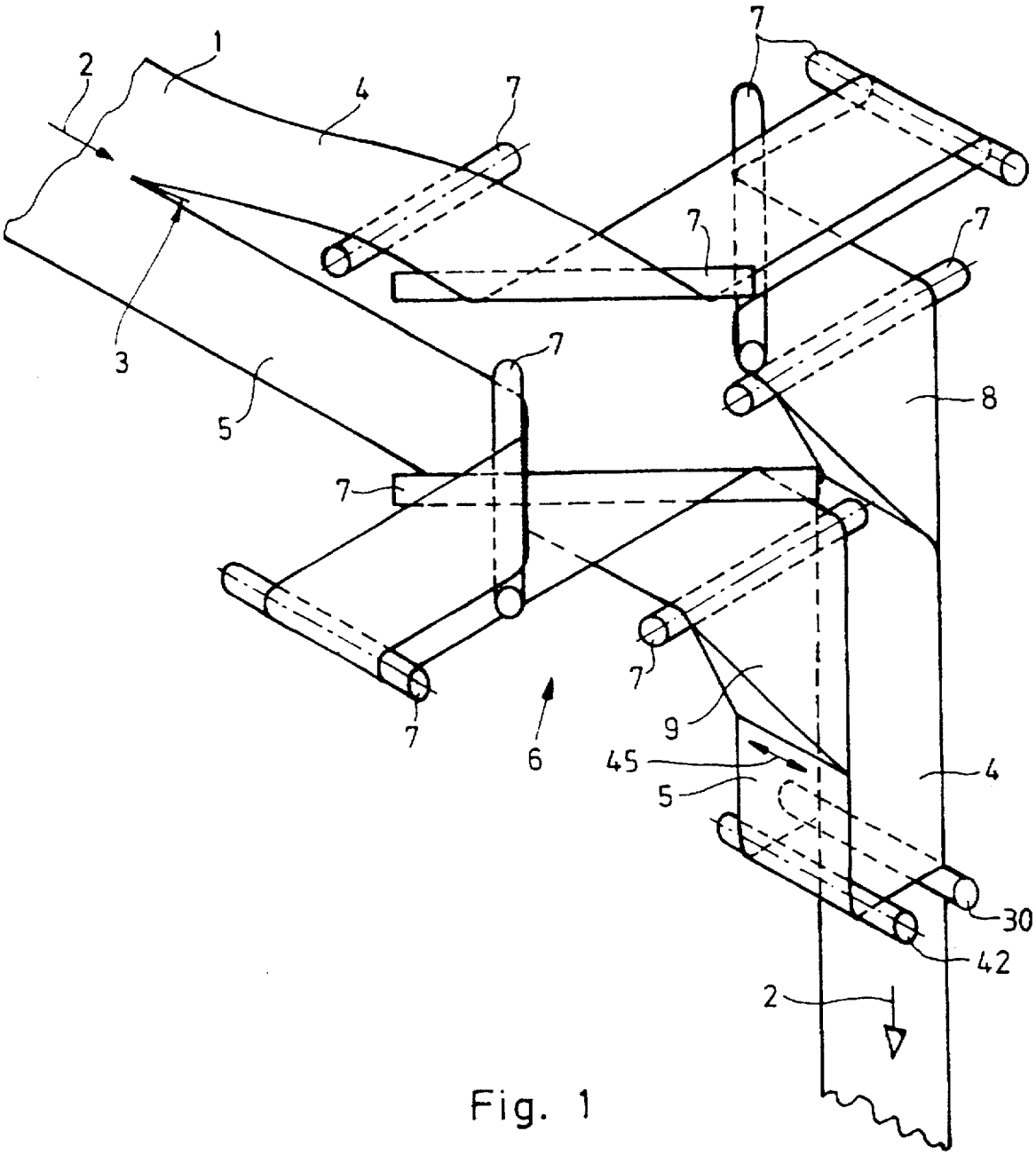
FIG. 1 is a diagrammatic perspective view of a device for guiding a web of paper coming from a rotary printing press.

Referring now to the drawings and, first, particularly to FIG. 1 thereof, there is shown therein a web 1 coming from a non-illustrated rotary printing press and moving in a direction of travel represented by the arrow 2. The web 1 is divided into two strips or web sections by means of a diagrammatically represented longitudinal cutting device 3. The two strips 4 and 5, which are printed, are conducted to a guide commonly known as a "web turner"6 formed of several deflecting rods or bars and deflecting rollers 7, respectively, arranged horizontally and at an inclination. By means of this web turner 6, the strips 4 and 5 are diverted, and possibly reversed in direction, which makes it possible to orient the two strips 4 and 5 relative to one another in the longitudinal direction. The two strips 4 and 5, respectively, are then guided to a respective folder former 8 or 9 (represented in FIG. 2). The strip 4 arrives at the folder former 8 and is folded longitudinally thereat. The longitudinal fold corresponds to a fold in the direction of travel of the strip. Simultaneously, the strip 5 arrives at the folder former 9 and is likewise folded longitudinally thereat. The two strips 4 and 5 are then superimposed on one another with a view to being processed in accordance with two different processing configurations.

Figure 2:
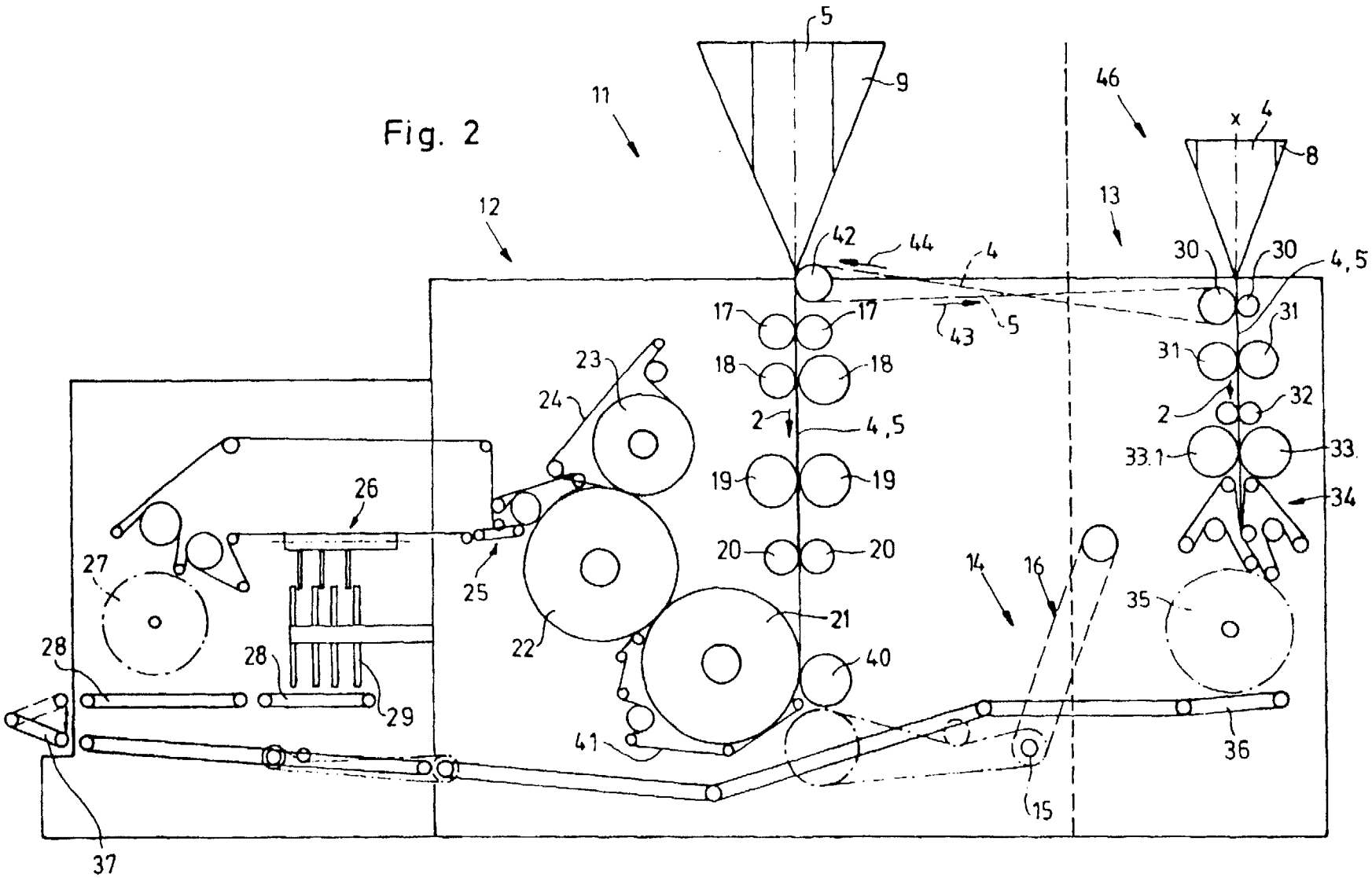
FIG. 2 is a diagrammatic side elevational view of a folding apparatus (main folder) to which an auxiliary cutting module has been added.
Figure 3:
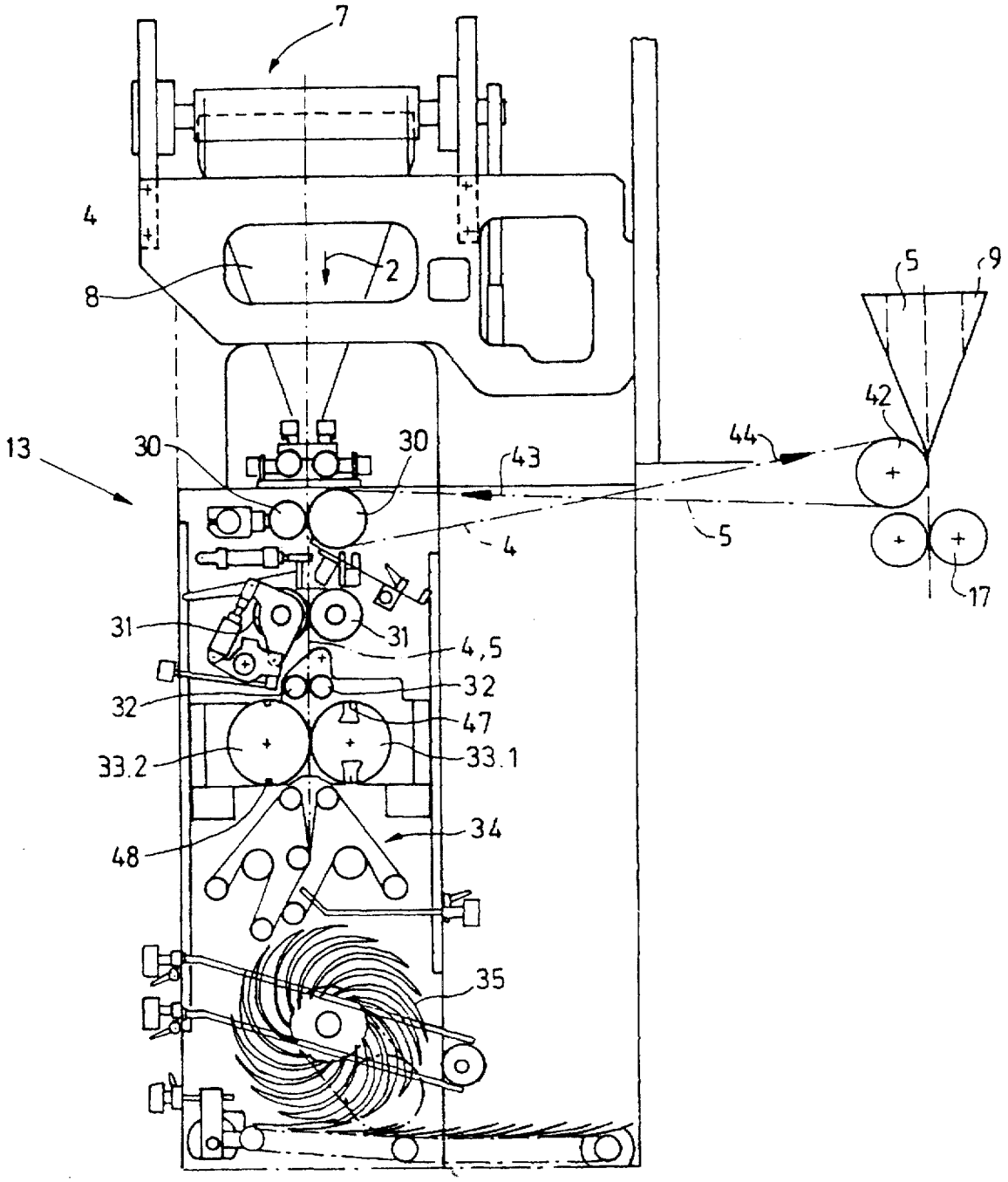
FIG. 3 is an enlarged fragmentary view of FIG. 2, as seen from behind the drawing plane thereof and showing the auxiliary cutting module in greater detail.

According to the first configuration represented in FIG. 1, the route or travel path of the strip 5, which is represented by the arrow 43 in FIGS. 2 and 3, is partly wound or rolled around a deflecting roller 42, then around a draw roller 30 so as to come to lie against the strip 4, the two strips 4 and 5 thus being superimposed on one another and being set for processing by the auxiliary cutting module 46, as is described hereinafter in greater detail.

According to the second configuration, the strip 4 is partly wound or rolled around the draw roller 30, then around the deflecting roller 42 (the route or travel path thereof is denoted by the arrow 44 in FIGS. 2 and 3) to come to lie against the strip 5. The two strips 4 and 5 are thus superimposed on one another for processing by the main folding device 12 as will be described in greater detail hereinafter.

It should be noted that the folder former 8 is stationary while the folder former 9 can move depthwise, i.e., in a direction represented by the arrow 45 in FIG. 1, so that the two folder formers 8 and 9 can be either aligned with or offset from one another.

When the two folder formers 8 and 9 are mutually aligned, the two folded strips 4 and 5 are exactly superimposed on one another and, in the first configuration, as is described hereinafter in greater detail, mainly yield a finished product known as "by 4 pages" in a single shingle stream.

When the two folder formers 8 and 9 are mutually offset, the two folded strips 4 and 5 are no longer precisely superimposed on one another, but are offset with respect to one another, so that the copies subsequently obtained by processing the strips will be easy to separate out and, as is described in greater detail hereinafter, will mainly yield a finished product known as "2 by 4 pages" in two parallel shingle streams.

In accordance with another path which has not been illustrated, the strips 4 and 5 may be deflected in the web turner 6 so that they are mutually superimposed and are both sent either over the folder former 8 or over the folder former 9, which then, respectively, folds the two mutually superimposed strips 4 and 5 longitudinally.

In such cases, the finished products are known as "2 by 8 pages", as described in greater detail hereinafter.

In FIG. 2, a folding apparatus 11 is diagrammatically represented and includes a folder former 9, such as is also represented in FIG. 1, and a main folder or folding device 12. Associated with the folding apparatus 11 and, thereby, with the main folding device 12, is an auxiliary cutting module 46 which includes a folder former 8, such as is also represented in FIG. 1, and a cutting device 13. The auxiliary cutting module 46 is independent of the folding apparatus 11 and, as required, may optionally be added to the folding apparatus 11, and then removed when no longer needed.

Such an auxiliary cutting module 46 is commonly known as a "4-page module". This auxiliary cutting module 46 does not have its own drive but is coupled by means of a force transmission device 14 to a drive 15 of the folding apparatus 11. The force transmission device 14 is a belt-type transmission 16 or alternatively may be a chain-type transmission or a gear transmission.

According to FIG. 2, the main folding device 12 includes draw rollers 17 which are arranged on both sides of the travel path of the strips 4 and 5 and suspended from a location close to the outlet of the folder former 9. These draw rollers 17 are followed by longitudinally perforating cylinders 18 also arranged on both sides of the path of the strips 4 and 5. Following the longitudinally perforating cylinders 18 in the direction of travel (arrow 2) are transversely perforating cylinders 19 which are, in turn, followed by draw rollers 20 with which a cutting cylinder 40 for cutting the strips 4 and 5 transversely into various copies once per each revolution of the cutting cylinder 40 is associated, the transverse direction corresponding to a direction perpendicular to the travel direction of the paper. The cutting cylinder 40 has a suitable circumference C which determines the length C of the cut copies. Downstream from the cutting cylinder 40 along the travel path of the copies is a chopper or tucker blade cylinder 21 which cooperates with a folding-jaw cylinder 22. A conveyor belt device 41 with a multiplicity of deflecting rods is provided to hold the copies against the folding blade cylinder 21. Furthermore, an auxiliary fold cylinder 23 is provided with which a conveyor belt device with an additional number of deflecting rods 24 is associated. A fan wheel 27 is assigned to the outlet of the folding-jaw cylinder 22 and of the auxiliary fold cylinder 23 and is able to deposit the folded copies on a conveyor belt 28. Moreover, a take-up device 25 is provided, via which the copies reach a longitudinal folding device 26 to which a fan wheel 29 is assigned. The fan wheel 29 cooperates with a conveyor belt 28 which is operatively connected with a deposit site and a deposit belt 37, respectively.

It will be noted that, between the folding apparatus 11, i.e., at the outlet of the folder former 9, and the inlet to the auxiliary cutting module 46, a transfer device is provided which is formed of a deflecting roller 42 freely mounted at the outlet of the folder former 9, and operatively associated with or assigned to a draw roller 30 arranged at the outlet of the folder former 8. Such a transfer device serves either to guide the strip or web section 4 folded longitudinally by the folder former 8 of the auxiliary cutting module 46 towards the main folding device 12 in the direction of the arrow 44, or to guide the strip 5 from the main folding device 12 towards the auxiliary cutting module 46.

The main folding device 12 operates in the following manner:

The strips 4 and 5 mutually superimposed and simultaneously folded either at the roller 42 or upstream of the former folder 9, enter the main folder or folding device 12 between the two draw rollers 17. The strips 4 and 5 are then perforated longitudinally by the longitudinally perforating cylinders 18, and then perforated transversely by the transversely perforating cylinders 19. The strips 4 and 5 then pass between the two draw rollers 20 and are cut transversely by the cutting cylinder 40. As the strips 4 and 5 leave the cutting cylinder 40, they are converted into respective copies having the length C.

The copies continue to advance, winding around the tucker or chopper blade cylinder 21, while being held against the latter by the conveyor belt with the multiplicity of rods 41. The chopper blade cylinder 21 cooperating with the jaw cylinder 22 folds the copies transversely.

The copies may occasionally also be transferred to the auxiliary fold cylinder 23 by means of the conveyor belt with the plurality of rods 24, and are generally transferred therefrom directly to the take-up device 25. The copies thus reach the longitudinal folding device 26, which forms a second longitudinal fold therein. The corresponding product is commonly known by those skilled in the art as"1 by 32 pages".

As the copies leave the longitudinal folding device 26, they are inserted in the pockets of the fan wheel 29, which deposits them on the deposit belt 28 in the form of a shingle stream which is then conveyed towards the deposit site or belt 37.

It is possible that the copies may not be formed with a second longitudinal fold but that they go instead directly to the fan wheel 27 cooperating with the deposit belt 28 which conveys them towards the deposit belt 37.

The various products which can be received on the deposit belt 28 by means of the main folder or folding device 12 are as follows: When the strips 4 and 5 are superimposed on the folder former 9, then the products obtained are commonly known as "1 by 16 pages in transverse format". These products leave as a deposit shingle stream.

When the strips 4 and 5 are folded respectively on the folder formers 8 and 9, and when the folder former 9 is offset with respect to the folder former 8, the products obtained are then commonly known as "2 by 8 pages in transverse format". A series of booklet sections, respectively, containing 8 pages is then obtained, the booklet sections being separated out on the deposit belt 37 into two parallel shingle streams.

With respect to the FIGS. 2 and 3, respectively, the auxiliary cutting module 46, also known as a "4-page module", is described hereinafter. As has been explained hereinbefore with regard to the represented embodiment, the auxiliary cutting module 46 includes a folder former 8 located along a vertical axis X parallel to the folder former 9. Below this folder former 8 is a set of draw rollers 30 arranged on both sides of the straight vertical path X. These draw rollers 30 serve to draw the strip coming from the folder former kite 8 into the interior of the auxiliary cutting module 46, and to convey the strip 5, which is folded longitudinally by the folder former 9 of the folding apparatus 11, towards the auxiliary cutting module 26 in the direction of the arrow 43.

The strips 4 and 5, which are superimposed upon entering the auxiliary cutting module 46, follow a straight vertical path along the axis X. On this path, they pass between two folder rollers 32, respectively, positioned on both sides of the strips 4 and 5, while traveling along the path X in the direction of the arrow 2. These folder rollers 32 make the strips 4 and 5 ready for entry into a cutting device made up of a cutting cylinder 33.1 located on one side of the traveling superimposed strips 4 and 5 and of a counter-cutting cylinder 33.2 arranged on the other side of the traveling strips 4 and 5 and at the same level as that of the cutting cylinder 33.1, so that they mutually cooperate. The cutting cylinder 33.1 includes two knives or blades 47 which are angularly offset (by half of a rotation), as represented more particularly in FIG. 3. The counter-cutting cylinder 33.2 is outfitted with two identical counter-cutting parts 48 which are angularly offset (also by half of a rotation). The developed length of the circumferences of the cutting cylinder 33.1 and of the counter-cutting cylinder 33.2 is equal to the value C which is that of the developed circumference of the cutting cylinder 40 of the main folder or folding device 12. The cutting cylinder 33.1 cooperating with the cylinder 33.2 cuts through the mutually superimposed strips 4 and 5 transversely, in fact, twice in succession per revolution of the cylinders 33.1 and 33.2, namely every half of the developed length C.

It should be emphasized that the mutually superimposed strip or strips 4 and 5 are processed between the inlet to the auxiliary cutting module 46 at the inlet to the draw rollers 30 thereof, and the outlet of the auxiliary cutting module 46 at the outlet from the cutting and the counter-cutting cylinders 33.1 and 33.2, respectively, thereof, following a straight vertical path. Such a layout allows for a compact auxiliary cutting module 46 with a path of reduced length requiring no conveyor belts. Upon leaving the auxiliary cutting module 46, the copies are transferred by means of a conveyor belt device 34 into the pockets of a fan wheel 35 which deposits them in overlapping or shingled configuration on the conveyor belt 36. This conveyor belt 36 permits the copies to be transferred to the deposit belt 37 which is common both to the folding machine 11 and to the auxiliary cutting module 46.

The various products which may be obtained at the outlet of the auxiliary cutting module 46 are as follows:

When the longitudinally and independently folded strips or web sections 4 and 5 are found precisely superimposed downstream of the folder former 8, products are obtained which are commonly known by those skilled in the art as "4by 4 pages", namely a run of 4 sections containing 4 pages, respectively, which emerge as a shingle stream deposit.

When the strips longitudinally and independently folded strips or web sections 4 and 5 are found mutually superimposed, but slightly offset from one another, downstream of the folder former 8, the products which are obtained are known by those skilled in the art as "2 by 4 pages", namely a run of 2 sections containing 4 pages, respectively, which are divided into two shingle streams on the deposit belt 37.

When the strips 4 and 5 are mutually superimposed either on the folder former 9 or on the folder former 8, the products obtained are known as "2 by 8 pages", namely a run of 2 sections containing 8 pages, respectively.

The invention disclosed herein is in no way limited to the embodiments described and represented, but those persons skilled in the art will know how to make any modifications in accordance with the spirit of the invention.

We claim:

1. Folding apparatus having a main folder and an associated auxiliary cutting module for cutting into copies at least one longitudinally folded strip or web section originating from a web coming from a rotary printing press, the auxiliary cutting module comprising an inlet thereto for the at least one strip, and an outlet therefrom for respective copies cut from the at least one strip, said inlet and said outlet defining therebetween a straight travel path for the at least one strip and the copies cut therefrom, the auxiliary cutting module having a longitudinally folding former section assigned thereto, the feeding of the web sections being fed to the main folder and the auxiliary cutting module, respectively, being changed vice versa to superimpose said web sections prior to common entry thereof in the main folders or in the auxiliary cutting module.

2. Folding apparatus in accordance with claim 1, wherein said straight travel path through the auxiliary cutting module is a vertical path.

3. Folding apparatus in accordance with claim 1, including a deposit site common to both the main folder and the auxiliary cutting module for receiving the copies thereon, and a conveyor belt arranged between said outlet of the auxiliary cutting module and said deposit site for conveying the copies produced by the auxiliary cutting module to said deposit site.

4. Folding apparatus in accordance with claim 3, wherein the auxiliary cutting module, at said outlet thereof, includes a fan wheel for accepting the cut copies therein and arrange depositing them in a shingle stream layer on said conveyor belt.

5. Folding apparatus in accordance with claim 1, including a force transmission device for transmitting driving force from a drive of the folding apparatus to the auxiliary cutting module for driving the latter.

6. Folding apparatus in accordance with claim 5, wherein said force transmission device has a construction selected from the group of constructions consisting of belt transmissions, chain transmissions and gear transmissions.

7. Folding apparatus in accordance with claim 1, wherein the main folder has a folder former for longitudinally folding at least one strip originating from a web coming from a rotary printing press, and including a web transferring device for transferring the strip between an outlet of the folder former of the main folder and said inlet of the auxiliary cutting module.

8. Folding apparatus in accordance with claim 1, wherein the auxiliary cutting module has a folder former for longitudinally folding at least one strip originating from a web coming from a rotary printing press.

9. Folding apparatus according to claim 1, including at least one other former section and wherein one of said former sections is depthwise moveably arranged with respect to the other.

* * * * *